US010968009B2

(12) United States Patent
Fernandes

(10) Patent No.: US 10,968,009 B2
(45) Date of Patent: Apr. 6, 2021

(54) CONSTRUCTIVE ARRANGEMENT FOR THE OPENING OF A BEVERAGE CAN

(71) Applicant: João Marques Fernandes, Belo Horizonte-MG (BR)

(72) Inventor: João Marques Fernandes, Belo Horizonte-MG (BR)

( * ) Notice: Subject to any disclaimer, the term of this patent is extended or adjusted under 35 U.S.C. 154(b) by 14 days.

(21) Appl. No.: 16/465,396

(22) PCT Filed: Nov. 29, 2017

(86) PCT No.: PCT/BR2017/050363
§ 371 (c)(1),
(2) Date: May 30, 2019

(87) PCT Pub. No.: WO2018/098550
PCT Pub. Date: Jun. 7, 2018

(65) Prior Publication Data

US 2020/0002051 A1 Jan. 2, 2020

(30) Foreign Application Priority Data

Dec. 1, 2016 (BR) ..... 2020160282727
Feb. 17, 2017 (BR) ..... 2020170032308

(51) Int. Cl.
*B65D 17/353* (2006.01)
*B65D 17/28* (2006.01)

(52) U.S. Cl.
CPC ..... *B65D 17/353* (2018.01); *B65D 17/4012* (2018.01); *B65D 2517/0094* (2013.01)

(58) Field of Classification Search
CPC .. B65D 17/16; B65D 17/353; B65D 17/4012; B65D 17/34; B65D 17/42; B65D 2517/0094
(Continued)

(56) References Cited

U.S. PATENT DOCUMENTS 3,221,924 A * 12/1965 Harvey ..... F16B 5/04 220/231
3,301,434 A * 1/1967 Harvey ..... B21D 51/383 220/231
(Continued)

FOREIGN PATENT DOCUMENTS

BR PI04033248 A 3/2006
BR 2020140320674 U2 7/2015
(Continued)

OTHER PUBLICATIONS

Brazilian Patent Application No. BR2020160009150 filed Jan. 15, 2016.
(Continued)

*Primary Examiner* — Don M Anderson
(74) *Attorney, Agent, or Firm* — Dinsmore & Shohl LLP

(57) ABSTRACT

An apparatus is disclosed and includes a can, which has an end wall incorporating a vent panel and a pouring panel, both panels presenting a contour defined by a rupture line. The apparatus includes an actuation tab with an extracting end portion affixed to the vent panel. The actuation tab includes a punching end portion affixed to the pouring panel and a lower end tooth to be pressed against a spot region of the rupture line of the pouring panel. The actuation tab includes a grip portion affixed to the extracting end portion and is designed to be manually and upwardly actuated for detaching the vent panel from the end wall. The grip portion is designed to punch and rupture the spot region of the rupture line of the pouring panel and, subsequently, detaching the latter from the end wall.

20 Claims, 5 Drawing Sheets

(58) Field of Classification Search
USPC ..... 220/269, 270, 231
See application file for complete search history.

(56) References Cited

U.S. PATENT DOCUMENTS

| | | | | |
|---|---|---|---|---|
| 3,477,608 | A | 11/1969 | Fraze | |
| 3,618,815 | A | 11/1971 | Heffner | |
| 3,655,091 | A | 4/1972 | La Croce | |
| 4,042,144 | A | 8/1977 | Henning et al. | |
| 4,094,435 | A | 6/1978 | Kennedy | |
| 4,913,305 | A | 4/1990 | Hanafusa et al. | |
| 5,411,159 | A | 5/1995 | Fan | |
| 6,062,414 | A | 5/2000 | Mongarli et al. | |
| 2003/0098306 | A1* | 5/2003 | Cho ..... | B65D 17/4012 220/269 |
| 2010/0219188 | A1* | 9/2010 | Chang ..... | B65D 17/4012 220/270 |
| 2010/0258562 | A1 | 10/2010 | Linden et al. | |
| 2014/0263320 | A1 | 9/2014 | Forrest et al. | |
| 2017/0057692 | A1 | 3/2017 | Fernandes | |
| 2017/0341808 | A1* | 11/2017 | Da Silva ..... | B65D 17/4012 |

FOREIGN PATENT DOCUMENTS

| | | | |
|---|---|---|---|
| BR | 2020160009150 | U2 | 9/2017 |
| GB | 353598 | A | 7/1931 |
| WO | 2016094977 | A1 | 6/2016 |

OTHER PUBLICATIONS

International Search Report for International Application No. PCT/BR2017/050363 dated Feb. 15, 2018.

* cited by examiner

CONSTRUCTIVE ARRANGEMENT FOR THE OPENING OF A BEVERAGE CAN

CROSS-REFERENCE TO RELATED APPLICATIONS

This application is a U.S. national stage application of International Application No. PCT/BR2017/050363 filed on Nov. 29, 2017, which claims the benefit and priority of Brazilian Patent Application No. BR 20 2017003230-8 filed on Feb. 17, 2017, and of Brazilian Patent Application No. BR 20 2016028272-7 filed on Dec. 1, 2016, the entire contents of each of the above applications are incorporated herein by reference.

TECHNICAL FIELD

The present disclosure relates to a constructive arrangement applied to a beverage can, for allowing a quick and easy opening of the latter, by the provision of a vent opening and of a pouring opening in an end wall of the can, usually the upper wall or lid, by the manual actuation of a user/consumer over a single actuation tab, in order to detach the latter, easily and rapidly, from the end wall of the can, jointly with respective vent and pouring panels, which are breakably incorporated to said end wall, in order to form respective vent and pouring openings.

BACKGROUND

It is well known in the state of the art the use of cans having an end wall provided with a first and a second breakable panels, in order to form, respectively, a vent opening and a pouring opening, the vent opening being diametrically spaced from the pouring opening, so as to assume an upper position in relation to the latter, when the can is inclined to a horizontal position, in order to allow the air to be continuously admitted into the can through the vent opening, while the beverage is being poured out from the can through the pouring opening. The provision of the vent opening allows the beverage to be released from the can, in a uniform flow and more rapidly.

Patent documents BR 20 2016 000915-0, BR 20 2016 006035-0, and US 2014/0263320 A1 illustrate the type of construction mentioned above, according to which the actuation of the user/consumer over a single actuation tab, promotes, initially, the rupture of the first panel (vent panel), with the formation of the vent opening for facilitating the discharge of the beverage through the pouring opening, which is subsequently formed upon the rupture of the second panel, by the progressive action of the user/consumer over the single actuation tab.

In said known beverage cans, having two breakable panels, the actuation of the single actuation tab leads to the formation, not only of the vent opening, by removing the vent panel, but also, and subsequently, of the pouring opening, by pressing the second breakable panel, or pouring panel, to the interior of the can. The pouring panel is bent around a reduced and not weakened extension of its breakable contour, which extension operates as a hinge defined by the metal foil itself of the respective end wall of the can. In this known construction, the pouring panel remains attached to the end wall of the can, projecting to the interior of the latter, remaining in contact with the beverage and transmitting, to the latter, for ingestion of the user/consumer, all the pathogenic microorganisms usually present in the exterior of the end wall or lid of said cans, when the latter are not submitted to a rare efficient cleaning before being opened and, mainly, before being used as a "drinking glass".

On the other hand, the solution of patent PI 0403324-8 provides two actuation tabs, which requires the user/consumer to pull one actuation tab to form the vent opening and to allow access to the other actuation tab to be optionally pulled to form the pouring opening. Although allowing only the formation of the vent opening for introducing a straw to consume the beverage, said prior solution does not eliminate the inconvenience of maintaining the pouring panel projecting to the interior of the can upon the formation of the pouring opening.

Patent documents GB 353,598, U.S. Pat. Nos. 3,655,091, 4,042,144, 4,913,305 and BR 20 2014 032067-4 describe different constructions for providing the opening of a pouring panel in an end wall of a can, by a single lever or tab which, when actuated by the user/consumer, promotes, initially, a localized rupture in the weakened line of the breakable contour of the pouring panel, allowing the tab or lever to be then pulled by the user/consumer, completing the rupture of the whole contour of the pouring panel which is then detached from the can, without the inconvenience of being pressed to the interior of the latter and contacting the stored beverage.

Although eliminating the problem of bending the pouring panel to the interior of the can, the constructive solutions mentioned in the previous paragraph do not allow the user/consumer to provide a vent opening for allowing the beverage to be released from the can in a uniform and more rapid flow.

Patent document U.S. Pat. No. 3,477,608 describes a constructive solution to provide the formation of a vent opening and, subsequently, the formation of a pouring opening in an end wall of a can, by a single lever or tab which, when actuated by the user/consumer, promotes a complete rupture of a vent panel and a localized rupture in the weakened line of the breakable contour of the pouring panel, allowing the single tab or lever to be then actuated by the user/consumer, completing the rupture of the entire contour of the pouring panel, which is then detached from the can, without the inconvenience of being pressed to the interior of the latter and contacting the store beverage.

Although eliminating the inconvenience of bending the pouring panel to the interior of the can and of providing both the vent opening and the pouring opening, by using a single actuation tab and requiring the user/consumer to make only one operation, said prior solution has the grip portion of the single tab/rod unduly short, making difficult for the user/consumer to manually access it, and uncomfortable to hold the actuation tab and, many times, requiring the use of an additional tool. In said prior solution, the vent opening is positioned close to the pouring opening, for allowing the grip portion of the actuation tab to have a certain extension, even though being a minimum one and insufficient to assure an ergonomic gripping. As a consequence of the position of the vent opening, the actuation of the latter, as a vent for equalizing the pressure and facilitating the release of the beverage through the pouring opening, is practically eliminated when the user/consumer initiates the operation of consuming the beverage directly from the can, through the pouring opening. In this condition, with the can full of liquid, the vent opening proposed by U.S. Pat. No. 3,477,608 no longer operates as a pressure equalizing element. The function of said prior vent opening is restricted to equalize the pressure only at the initial opening phase of the can, in order to prevent the beverage from spilling outwardly from the can towards the user/consumer.

Patent application BR20 2016 000915 0, of the same applicant, provides a single actuation tab to be actuated in a single, easy and ergonomic operation to provide the pouring and vent openings, without using an additional tool. The actuation tab has a pressing end portion and an extracting end portion, it being affixed to the latter a hinge end of a grip portion to be angularly and upwardly displaced, by the user, from a retracted inoperative condition, contained inside the contour of the end wall, and an operative condition, of manual gripping, in order to apply an upward force for pivoting the actuation tab, so that said tab may project upwardly from the peripheral edge of the can.

The constructive arrangement, object of said BR 20 2016 000915 0, provides a single actuation tab which is easy to handle, without requiring the use of additional tools, not interfering with the stacking operation of the cans, and leading to the rupture of a vent panel and of a pouring panel, which are diametrically spaced from each other, and to the consequent formation of the vent and pouring openings, by the user/consumer making only one operation to move/movement on the actuation tab. However, said prior solution still presents the inconvenience of maintaining the pouring panel pressed to the interior of the can, having contact with the stored beverage.

SUMMARY

Due to the above-mentioned inconveniences related to the known solutions, it is an object of the present disclosure to provide a constructive arrangement for the opening of a beverage can, which allows the user/consumer to promote the formation of a vent opening and the subsequent formation of a pouring opening spaced from the vent opening, with the respective vent and pouring panels, which are incorporated to the end wall of the can and form the vent panel and the pouring panel, respectively, being totally detached outwardly from the can, without being bent to the interior of the latter.

BRIEF DESCRIPTION OF THE DRAWINGS

The disclosure will be described below, with reference being made to the appended drawings, given by way of example of a possible construction for the present constructive arrangement, and in which.

DETAILED DESCRIPTION

Figure 1:
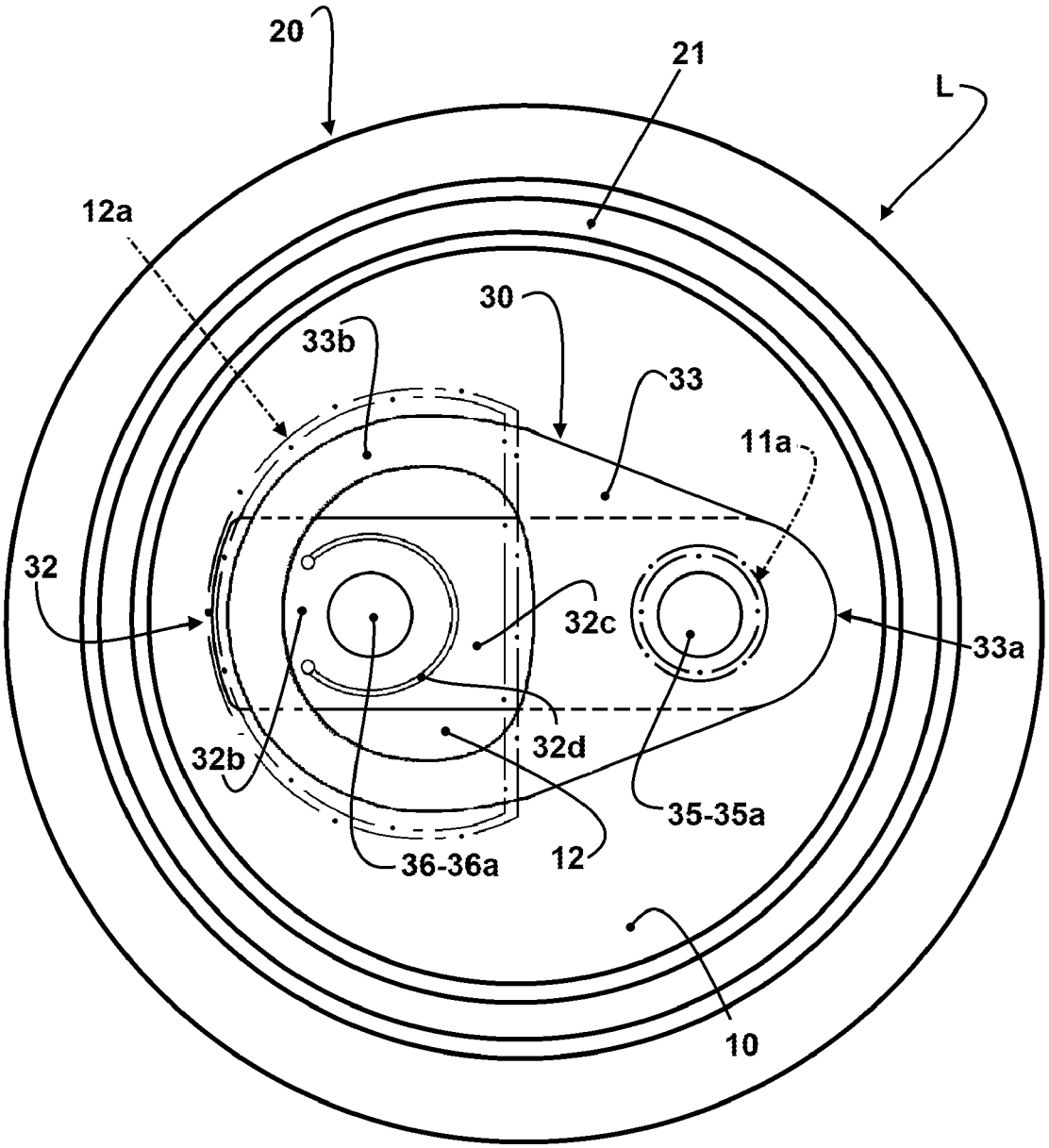
FIG. 1 represents an upper plan view of a beverage can of the type considered herein, in the closed condition and provided with the actuation tab proposed in the present disclosure.

As illustrated in the appended drawings and mentioned above, the present constructive arrangement is applied to a beverage can L of the type which comprises an end wall 10, usually in the form of an upper lid and surrounded by an adjacent peripheral edge 21 defined at one of the ends of a generally cylindrical lateral wall 20 of the can L. The end wall 10 incorporates a vent panel 11 and a pouring panel 12, which are spaced from each other usually in a diametrically opposite arrangement, with the pouring panel 12 presenting a contour usually much larger than that of the vent panel 11.

Figure 3:
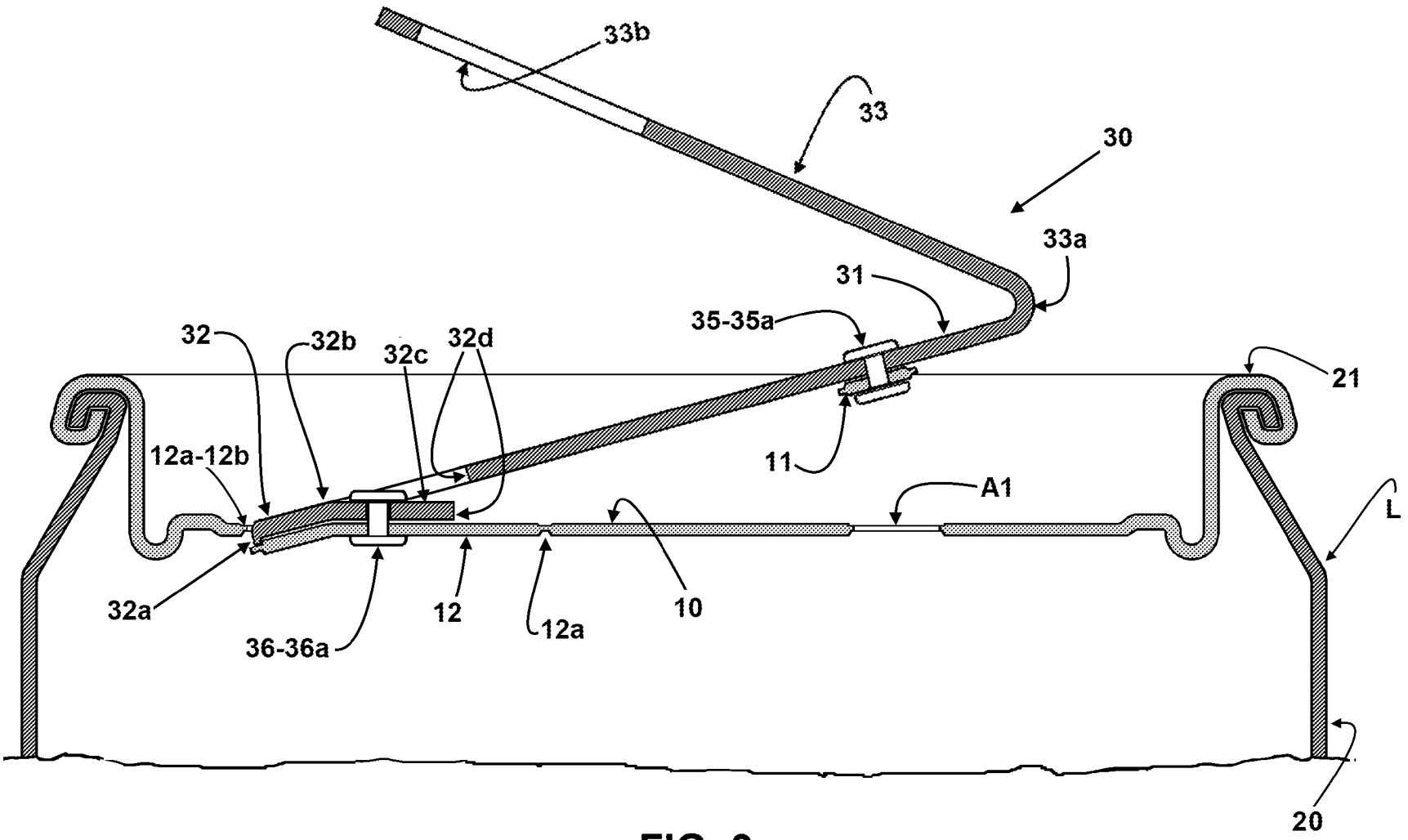
FIG. 3 represents an enlarged diametric sectional view of the upper portion of the can of FIG. 1, with the actuation tab being displaced by the user/consumer, in order to initiate the separation of the vent panel in relation to the end wall, for forming the vent opening and rupturing the spot region of the rupture line of the pouring panel.
Figure 4:
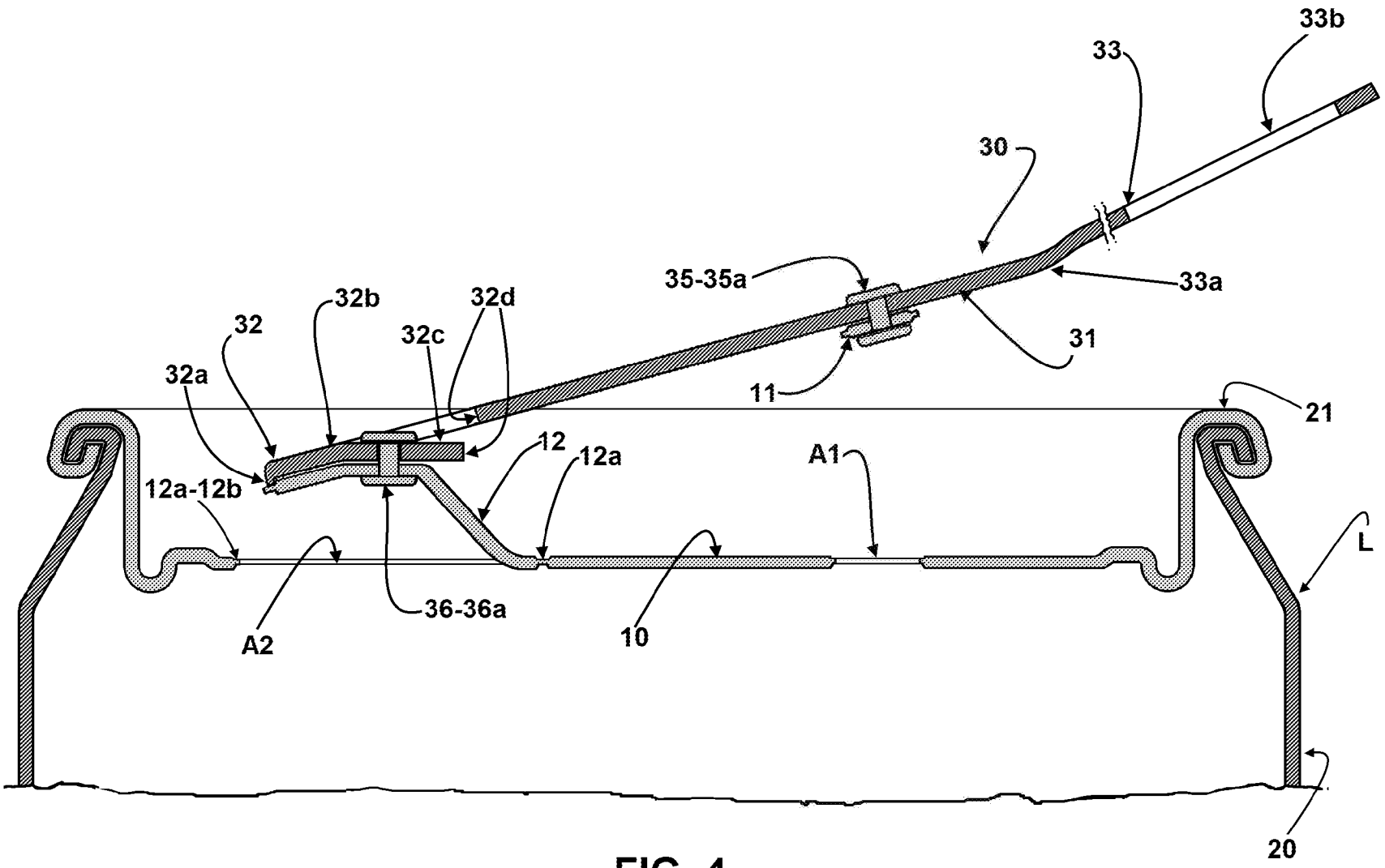
FIG. 4 represents an enlarged diametric sectional view of the upper portion of the can of FIG. 3, in which the actuation tab is already markedly displaced away from the end wall of the can, initiating the rupture of the remaining part of the rupture line and the consequent separation of the pouring panel in relation to the can, in order to form the pouring opening.
Figure 5:
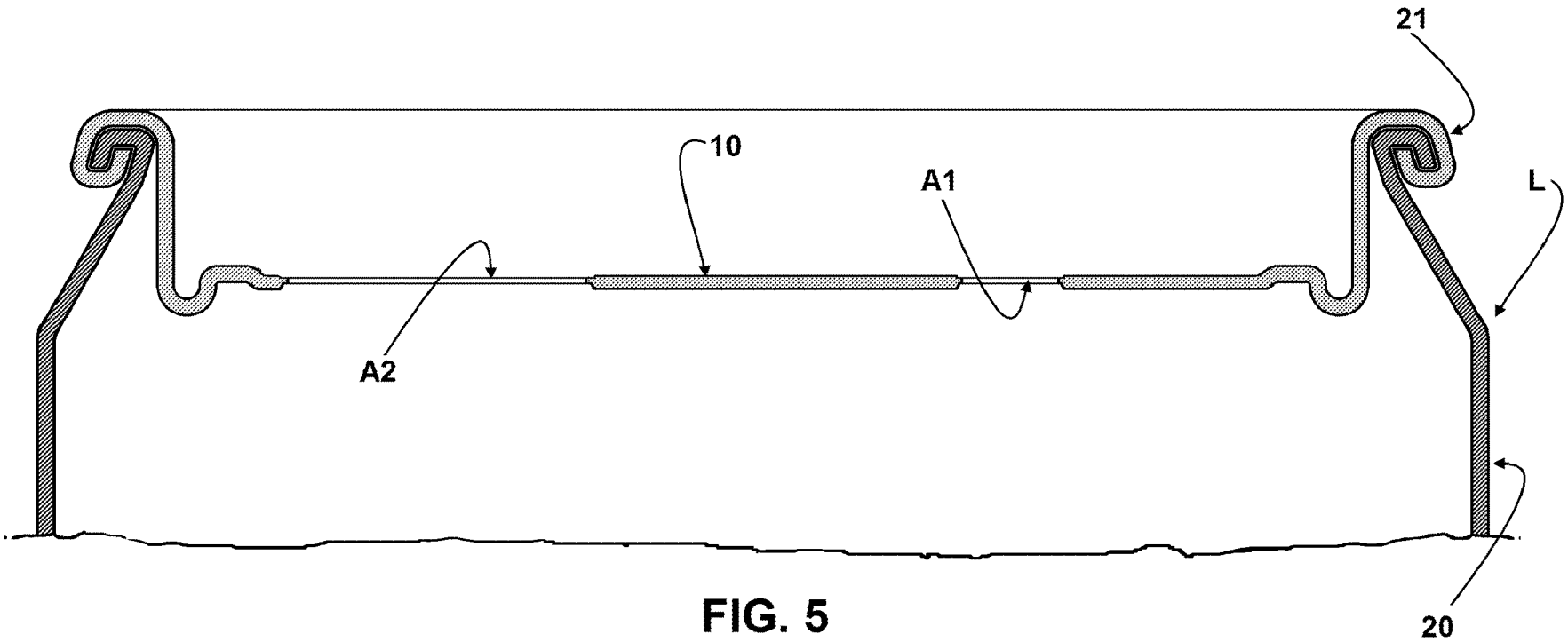
FIG. 5 represents the diametric sectional view illustrated in FIG. 4, but in which the actuation tab and the two panels have been totally detached from the can and discarded, in order to form the vent and pouring openings.

According to a first aspect of the present disclosure, the vent panel 11 and the pouring panel 12 have the contours thereof totally defined by respective rupture lines 11*a*, 12*a*, allowing said panels to be manually along the contours thereof, for the formation of a vent opening A1 (as illustrated in FIGS. 3, 4 and 5) and, subsequently, of a pouring opening A2, respectively, (as better illustrated in FIG. 4). This type of can may be constructed in different ways well known in the art.

The can L further comprises an actuation tab 30, constructed in a single piece and in any metal alloy adequate to the present use, having an extracting end portion 31, externally attached to the vent panel 11 by a retention element 35, of any known construction and which, for example, may take the form of a rivet 35*a*, hermetically incorporated to the vent panel 11 of the end wall 10. The actuation tab 30 further presents a punching end portion 32, externally affixed to the pouring panel 12, by a retention element 36, for example, in the form of a rivet 36*a*, the punching end portion 32 being provided with a lower end tooth 32*a*, designed to be pressed against the confronting spot region 12*b* of the rupture line 12*a* of the pouring panel 12.

The actuation tab 30 further comprises a grip portion 33, having a hinge end 33*a* affixed to the extracting end portion 31, and a free end 33*b*, the grip portion 33 being manually and upwardly displaceable, around its hinge end 33*a*, from a retracted inoperative position, to an operative position, spaced from the end wall 10 of the can L and in which it is upwardly actuated by the user/consumer, for upwardly elevating the extracting end portion 31 and thus, separating, from the end wall 10, the vent panel 11, punching and rupturing the confronting spot region 12*b* of the rupture line 12*a* of the pouring panel 12 and, subsequently, detaching the latter from the end wall 10.

The provision of the grip portion 33 of the actuation tab 30 allows providing the user/consumer with a good grip for pulling said actuation tab 30, since the initial moment of the upward displacement of its extracting end portion 31, which may make unnecessary the provision of a tongue portion joining the extracting end portion 31 to the respective retention element 35, as described herein below in relation to the punching end portion 32 of the actuation tab 30.

The punching end portion 32 of the actuation tab 30 incorporates, in a single piece and through a hinge region 32*b*, a tab portion 32*c* cutout from the actuation tab 30 by a cutout 32*d* in the form of a rounded "C" said tab portion 32*c* to define the portion of the actuation tab 30 attached to the retention element 36.

After the extracting end portion 31 of the actuation tab 30 has been sufficiently displaced to detach the vent panel 11 and the respective retention element 35 in relation to the end wall 10 of the can L, with the progressive upward displacement of the actuation tab 30 by the user/consumer, the lower end tooth 32*a* is pressed against the confronting spot region 12*b* of the rupture line 12*a*, external to the cutout 32*d* and to the hinge region 32*b* of the tab portion 32*c*, rupturing the rupture line 12*a* in said confronting spot region 12*b* and allowing the progressive upward displacement of the actuation tab 30 to be effected around the hinge region 32*b*, until occurring the initial rupture of the pouring panel 12 by the lower end tooth 32*a* and, with the progressive upward angular displacement of the actuation tab 30, is obtained the complete rupture of the rupture line 12*a* and the consequent complete separation of the pouring panel 12, of the retention element 36 and of the actuation tab 30 in relation to the can L.

Although not illustrated herein, the extracting end portion 31 of the actuation tab 30 may incorporate, in a single piece and through a hinge region, a tongue portion cutout from the actuation tab 30 by a cutout in the form of a rounded "C", similarly as described in relation to the punching end portion 32, allowing said tongue portion to define the portion of the actuation tab 30 affixed to the retention element 35 associated to the vent panel 11.

In the constructive variant described in the above paragraph (not illustrated), the tongue portion of the extracting end portion 31 of the actuation tab 30 allows the initial upward angular displacement of the extracting portion of the actuation tab 30 to be effected around the hinge region. With the progressive upward angular displacement of the actuation tab 30, it is obtained the complete rupture of the rupture line 11*a* and the consequent complete separation of the vent panel 11 in relation to the can L.

In the illustrated construction, the grip portion takes the form of an extension of the extracting end portion 31 of the actuation tab 30, usually formed in a single piece with the extracting end portion 31 and the punching end portion 32 of the actuation tab 30.

In the illustrated form, the grip portion 33 is an axial extension of the extracting end portion 31 of the actuation tab 30 and remains positioned over the extracting end portion 31 and the punching end portion 32, when in its retracted inoperative condition.

The manual and angular displacement of the actuation tab 30 pulls axially the retention element 35 away from the end wall 10 of the can L, provoking the rupture of the rupture line 11*a* of the vent panel 11, which is, then, integrally detached from the can L, forming the vent opening A1 (see FIGS. 3, 4 and 5) which may be dimensioned so as to receive a straw (not illustrated), when the user wishes to consume the beverage in this manner, reducing the risks of spilling.

During the angular displacement of the actuation tab 30 for rupturing the vent panel 11, the lower end tooth 32*a* of the punching end portion 32 ruptures the confronting spot region 12*b* of the rupture line 12, initiating the process of liberating the pouring panel 12.

With the progressive upward angular displacement of the actuation tab 30, the latter acts over the retention element 36, pulling it upwardly, in order to rupture the rupture line 12*a* of the pouring panel 12 and to separate totally the latter from the end wall 10 of the can L, forming the pouring opening A2 (see FIGS. 4 and 5).

Figure 2:
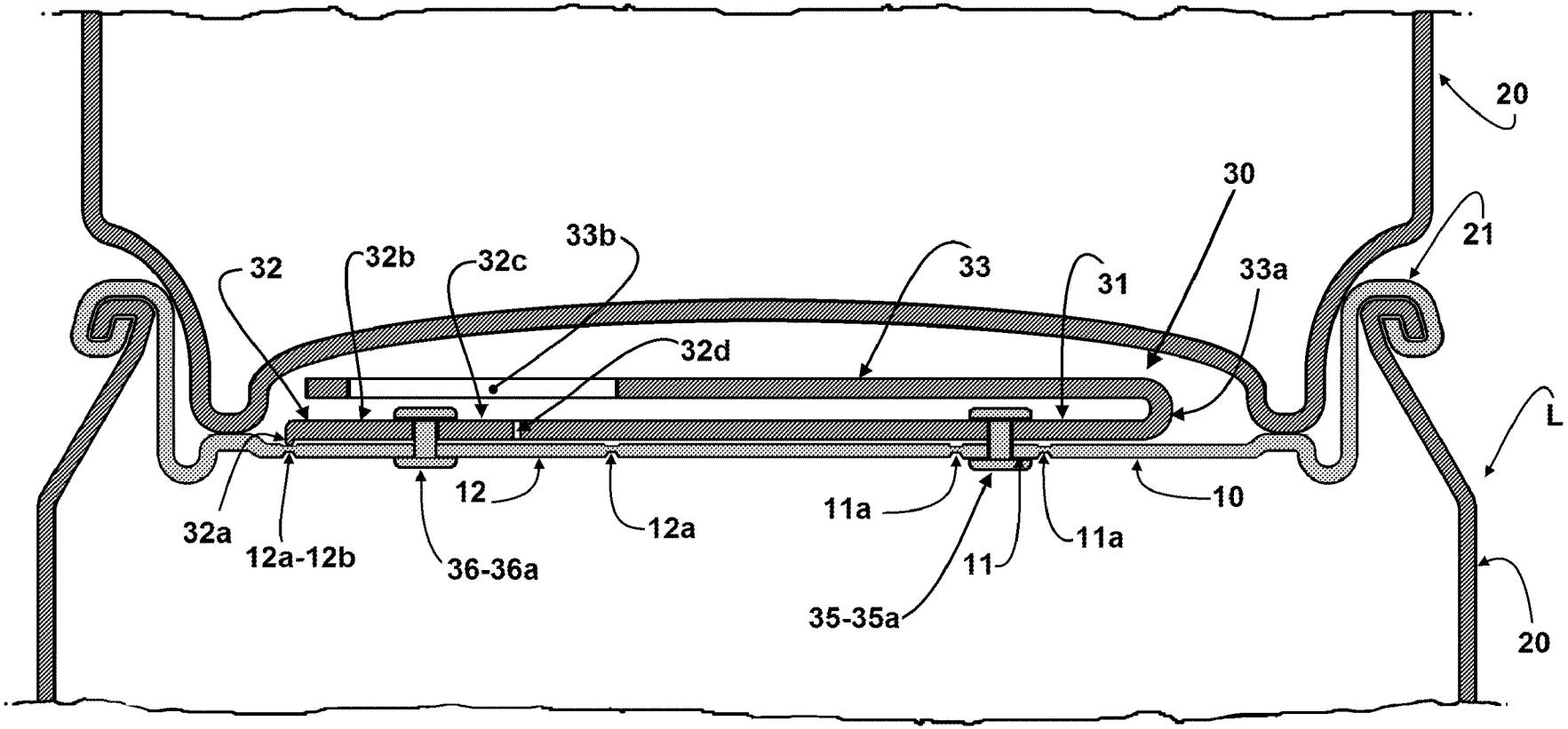
FIG. 2 represents an enlarged diametric sectional view of the upper portion of the can of FIG. 1, further illustrating the bottom of other can stacked thereon.

The present constructive arrangement allows the grip portion 33 of the actuation tab 30 to remain contained, in its retracted inoperative position, within the contour of the end wall 10, between the latter and the plan of the adjacent peripheral edge 21 of the can L, not interfering with the bottom of an identical can L stacked thereon, as illustrated in FIG. 2.

In relation to the description above, it should be understood that example dimensional relationships for the components of the present disclosure include variations of size, materials, geometric forms, functions, operation modes, mounting arrangements usage will become apparent. All relationships equivalent to those illustrated in the drawings and described in the specification should be understood as encompassed by the present disclosure.

Thus, while only one way of carrying out the present disclosure has been illustrated herein, it should be understood that modifications as to form and constitution of the parts can be made, without departing from the protective scope defined in the claims that accompany the present specification.

The invention claimed is:

1. A constructive arrangement for the opening of a beverage can comprising:

an end wall surrounded by an adjacent peripheral edge of the can, the end wall including a vent panel and a pouring panel, the vent panel spaced apart from the pouring panel, the vent panel having a vent contour defined by a vent rupture line breakable for the formation of a vent opening, the pouring panel having a pouring contour defined by a pouring rupture line breakable for the formation of a pouring opening; and an actuation tab comprising:

an extracting end portion externally affixed to the vent panel;

a punching end portion externally affixed to the pouring panel, the punching end portion including, in a single piece, a hinge region and a tab portion cut out from the actuation tab by a cutout, said punching end portion being provided with a lower end tooth configured to be pressed against a confronting spot region of the pouring rupture line of the pouring panel, the lower end tooth provided on a side of the hinge region opposite the tab portion; and a grip portion having a hinge end and a free end, the hinge end affixed to the extracting end portion, the grip portion configured to be manually and upwardly displaceable about the hinge end from a retracted inoperative position to an operative position, the grip portion configured to separate the punching end portion from the end wall of the can to separate the vent panel from the can and, subsequently, detach the pouring panel from the end wall.

2. The constructive arrangement according to claim 1, wherein the cutout has a shape corresponding to a rounded "C", the cutout open to the hinge region.

3. The constructive arrangement according to claim 1, wherein the grip portion of the actuation tab remains contained within an outer perimeter of the end wall in a plan view when in the retracted inoperative position.

4. The constructive arrangement according to claim 1, wherein the extracting end portion and the punching end portion of the actuation tab are respectively affixed to the vent panel and to the pouring panel by a rivet.

5. The constructive arrangement according to claim 1, wherein the grip portion takes the form of an extension of the extracting end portion of the actuation tab.

6. The constructive arrangement according to claim 5, wherein the grip portion is formed in a single piece with the extracting end portion and the punching end portion of the actuation tab.

7. The constructive arrangement according to claim 5, wherein the grip portion is an axial extension of the extracting end portion and remains positioned over both the extracting end portion and the punching end portion when in the inoperative retracted condition.

8. The constructive arrangement according to claim 1, wherein the hinge end is provided between the grip portion and the extracting end portion.

9. The constructive arrangement according to claim 4, wherein the rivet extends through the tab portion.

10. The apparatus according to claim 1, wherein the extracting end portion is provided on a first side of the cutout and the tab portion is provided on an opposite second side of the cutout.

11. An apparatus for opening a can that includes an end wall having a vent panel and a pouring panel spaced apart from the vent panel, wherein a first contour of the vent panel is defined by a first rupture line, and wherein a second contour of the pouring panel is defined by a second rupture line, the apparatus comprising:

an actuation tab including an extracting end portion, a punching end portion, a tab portion, a lower end tooth, and a grip portion, wherein:

the extracting end portion is externally affixed to the vent panel;

the lower end tooth and the tab portion are separated via a hinge region;

the lower end tooth abuts a confronting spot region of the second rupture line;

the grip portion includes a hinge end and a free end;

the hinge end is coupled to the extracting end portion;

the grip portion is displaceable around the hinge end from a first position to a second position;

the second position is located above the first position relative to the end wall;

in response to actuating the grip portion, the lower end tooth is configured to break the confronting spot region of the second rupture line; and in response to breaking the confronting spot region of the second rupture line, the pouring panel is configured to separate from the end wall.

12. The apparatus of claim 11, further comprising a cutout having a shape corresponding to an arc disposed around the tab portion.

13. The apparatus according to claim 11, wherein:

the grip portion is located at the first position during a retracted and inoperative state;

the grip portion is located within an area defined by at least the end wall and a peripheral edge of the can; and the peripheral edge of the can is perpendicular to the end wall.

14. The apparatus according to claim 11, wherein:

the extracting end portion is affixed to the vent panel using a first rivet; and the punching end portion is affixed to the pouring panel using a second rivet.

15. The apparatus according to claim 11, wherein the grip portion extends from the extracting end portion in a same direction.

16. The apparatus according to claim 15, wherein the grip portion, the extracting end portion, and the punching end portion are integrated into a single component.

17. The apparatus according to claim 15, wherein:

the grip portion is an axial extension of the extracting end portion; and while the grip portion is at the first position, the grip portion is positioned above the extracting end portion and the punching end portion relative to the end wall.

18. The apparatus according to claim 11, wherein the hinge end is provided between the grip portion and the extracting end portion.

19. The apparatus according to claim 14, wherein the second rivet extends through the tab portion.

20. The apparatus according to claim 11, wherein the extracting end portion is provided on a first side of the cutout and the tab portion is provided on an opposite second side of the cutout.

* * * * *